United States Patent [19]

Weisser et al.

[11] Patent Number: 4,656,914

[45] Date of Patent: Apr. 14, 1987

[54] STOOL AND AUXILIARY PEDAL FOR A KEYBOARD INSTRUMENT

[76] Inventors: Karl W. Weisser, 736 Meadowvale Road, West Hill, Ontario, Canada, M1C 1T2; Ngai H. Cheung, 2 Trimontium Crescent, Toronto, Ontario, Canada, M4C 5N7

[21] Appl. No.: 843,470

[22] Filed: Mar. 24, 1986

[51] Int. Cl.[4] ..... G10C 3/26

[52] U.S. Cl. ..... 84/232

[58] Field of Search ..... 84/230–232, 84/358

[56] References Cited

U.S. PATENT DOCUMENTS

| | | |
|---|---|---|
| 198,893 | 1/1879 | Mathias . |
| 688,416 | 12/1901 | Hopphan . |
| 759,959 | 5/1904 | Bates . |
| 1,007,980 | 11/1911 | Schreiner . |
| 1,040,397 | 10/1912 | Paczynski . |
| 1,269,717 | 6/1918 | Kirk . |
| 2,030,929 | 2/1936 | Miyashita . |
| 2,213,800 | 9/1940 | Ege . |
| 2,245,314 | 6/1941 | Willis . |
| 2,454,969 | 11/1948 | Kaufman et al. ..... 84/232 |
| 4,418,604 | 12/1983 | Kim . |

FOREIGN PATENT DOCUMENTS

| | | |
|---|---|---|
| 36882 | 11/1935 | Netherlands . |

*Primary Examiner*—Lawrence R. Franklin

*Attorney, Agent, or Firm*—Rogers, Bereskin & Parr

[57] ABSTRACT

A stool, for use with a keyboard instrument including at least one foot pedal, has a platform and an auxiliary pedal pivotally mounted to the platform. An actuating mechanism is connected to the foot pedal, and is adapted to contact and actuate the main, foot pedal of a keyboard instrument. A number of support legs extend down from the platform. A roller and roller guide assembly is provided, to enable the action of the auxiliary pedal to be transferred smoothly to the main piano pedal. One of the roller and the roller guide are connected to the actuating mechanism, while the other of the roller and the roller guide is mounted on the main pedal. To enable the height of the legs to be adjusted, each leg can comprise a main member, and two extension members.

22 Claims, 4 Drawing Figures

STOOL AND AUXILIARY PEDAL FOR A KEYBOARD INSTRUMENT

FIELD OF INVENTION

This invention relates to a stool and auxiliary pedal for pianos and similar instruments.

BACKGROUND OF THE INVENTION

A conventional piano includes a keyboard for operating the hammers, which strike the strings. Additionally, pedals are provided near the ground, for providing additional control. Commonly, a piano will have two pedals, namely a left-hand (una corda) pedal and a right-hand, damper pedal, which controls the length of time the sound is sustained. Additionally, some pianos include a third (sostenuto), damping or sustaining pedal, for controlling just part of the strings. The right-hand pedal is the most frequently used. Pianos come in a wide variety of shapes and sizes. Two principal types of piano are the upright piano and the grand piano. In the upright piano, the pedals extend directly from the main body of the piano, whereas for a grand piano the pedals extend from a separate pedal box.

As the basic height relationship between the pedals and the keyboard is determined by the design of the piano, learning to play a piano with pedal action presents difficulties for a yound child. If the child is at the right height to comfortably reach the keyboard, then the pedals will be too far away. A simple solution is simply for the child to only use the keyboard, until he or she is big enough to reach the pedals. However, this is undesirable. It is preferable for a child learning to play the piano, to learn to use the pedals as early as possible, and this can heighten musical expression and the childs's enjoyment.

It is also to be noted that, even if the child is not using the pedals, it is desirable for the child's feet to be comfortably placed on a level stool or the like.

This problem has been recognized, and many proposals have been made for dealing with it. The following patents all disclose mechanisms intended to deal with this problem, all of these patents being U.S. patents with the exception of the first patent which is a Dutch patent:

36,882 (Netherlands)
U.S. Pat. No. 198,893 Mathias
U.S. Pat. No. 688,416 Hopphan
U.S. Pat. No. 759,959 Bates
U.S. Pat. No. 1,007,980 Schreiner
U.S. Pat. No. 1,040,397 Paczynski
U.S. Pat. No. 1,269,717 Kirk
U.S. Pat. No. 2,030,929 Miyashita
U.S. Pat. No. 2,213,800 Ege
U.S. Pat. No. 2,245,314 Willis
U.S. Pat. No. 4,418,604 Kim A wide variety of different mechanisms are disclosed in these patents. They all suffer from various disadvantages. Many of them are complex and would be costly to make. Other mechanisms are only suited for a particular type of piano, and could not be applied to both grand pianos, and upright pianos.

Many of them disclose height adjusting mechanisms, which rely upon the simple principal of a shaft engaging a tube or cylinder. The two elements are held in relation to each other by a ratchet mechanism or screw mechanism. However, this severely limits the height range of the stool. The minimum height must be at least the height of the shortest element, whilst the maximum height must be less than twice the height of the longest element of the pair. In many cases, it is desirable for a foot stool to be adjustable through a wide range, e.g. through a range where the maximum is three times the minimum height.

A further disadvantage of some of these earlier proposals is that they employ relatively complex mechanisms for transferring the movement of an auxiliary pedal to the main, piano pedal. Many of them have a vertical action, which it has been found does not always function well. It is desirable that the mechanism should be robust, and transfer the movement of the auxiliary pedal to the main piano pedal in a reliable manner. Ideally, the displacement of the auxiliary pedal should be comparable to that of the main, piano pedal.

Another disadvantage of many known designs is that the stool is placed right up against the piano. It is to be realized that, for a yound child, a stool with pedals needs to be both higher and the pedals nearer than the main piano pedals. This ensures the child is in an optimal seating position at the piano.

A further disadvantage of earlier proposals is that they employ relatively simple and crude mechanisms for transferring the displacement from the mechanism of the device to the main, piano pedals. Preferably, this transfer of the displacement or motion should be accomplished in a smooth, reliable manner. It is desirable that the user should obtain the full feel of the main, piano pedals at the auxiliary pedals.

BRIEF SUMMARY OF THE INVENTION

In accordance with the present invention, there is provided a stool, for use with a keyboard instrument including at least one main, foot pedal, the stool comprising: a platform; a first, auxiliary pedal pivotally mounted above the platform; actuating means connected to the first, auxiliary pedal and adapted to contact and actuate a main, foot pedal; a plurality of support legs extending downwardly from the support platform; and a roller and guide assembly comprising a rotatably mounted roller and a roller guide member, with one of the roller and the roller guide member being adapted for mounting on a main pedal of a keyboard instrument and the other of the roller and the roller guide member being connected to the actuating means.

Preferably, the guide member is adapted for mounting to a main, foot pedal of a keyboard instrument, and includes clamping means for clamping the guide member to such a pedal.

In accordance with another aspect of the present invention, the support legs comprise a first member secured to the platform, a second, extension member connectable to the first member, and a third, extension member connectable to the second extension member.

The first member can comprise a threaded shaft, and the second, extension member can comprise a threaded cylinder, which engages the threaded shaft. The third, extension member can be a further threaded shaft, arranged to engage the threaded cylinder. For low heights, the second and third extension members can be omitted. For intermediate heights, the second extension members would be fitted, whilst for the larger heights, the third extension members would also be fitted. Appropriate foot supports can be fitted to the ends of the second and third extension members as required. By this means, adjustment in the range of, for example, 3–9 inches can be achieved.

The stool can include two or more auxiliary pedals, corresponding to the main pedals of a piano.

For each auxiliary pedal, the pedal can include a mounting leg, which extends downwards from the pedal and is pivoted at its mid point. The actuating means can then comprise: an arm disposed in front of the pedal and pivotally mounted adjacent the mid point thereof; a link pivotally connected between a lower end of the mounting leg and one end of the arm; and an actuating shaft adjustably mounted to the other end of the arm, with a lower end of the actuating shaft disposed to actuate a main, piano pedal.

BRIEF DESCRIPTION OF THE DRAWINGS

For a better understanding of the present invention, and to show more clearly how it may be carried into effect, reference will now be made, by way of example, to the accompanying drawings, which show preferred embodiments of the present invention and in which.

DESCRIPTION OF THE PREFERRED EMBODIMENT

Figure 1:
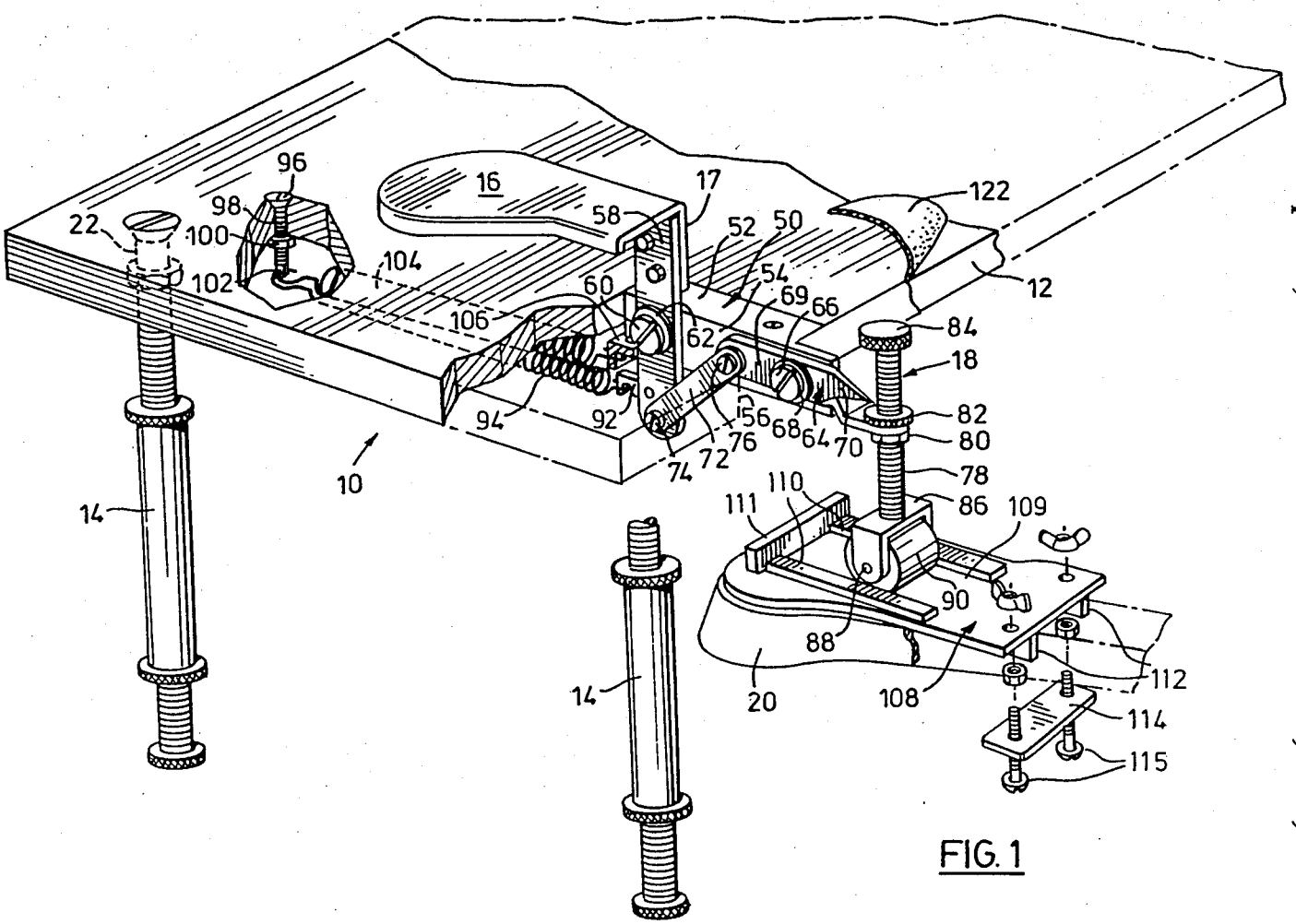
FIG. 1 shows a perspective view of a stool in accordance with the present invention.
Figure 3:
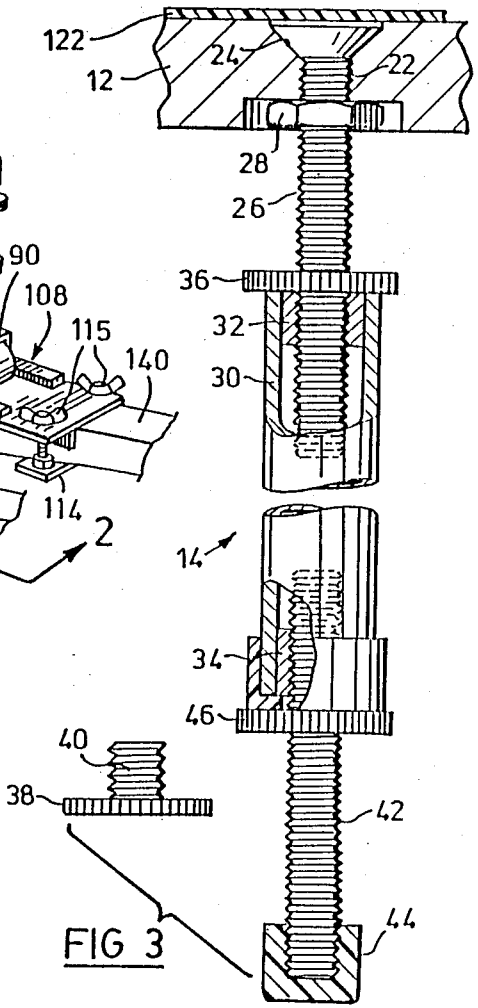
FIG. 3 shows a side view, in partial section, of a leg of the stool of the present invention.

In FIG. 1, the stool in accordance with the present invention is generally denoted by the reference 10. The stool 10 includes a platform 12, and four supporting legs 14. In FIG. 1, the supporting legs 14 are shown in their configuration providing the maximum height. The detailed construction of the supporting legs 14 is described below, in relation to FIG. 3. The stool 10 additionally includes an auxiliary pedal 16 and an actuating mechanism indicated generally at 18. A main pedal of a conventional piano is shown at 20. The actuating mechanism 18 serves to transfer movement or motion between the auxiliary pedal 16 and the main piano pedal 20, as detailed below.

The platform 12 includes bores 22 at each of its corners, for the supporting legs 14. Each bore 22 includes a countersunk top part 24. A screw 26 with a countersunk head is fitted in each bore 22. Each screw 26 is secured by a nut 28.

A second, extension member comprises an extension tube 30. The extension tube 30 includes upper and lower threaded plugs 32, 34. The upper threaded plug 32 engages the screw 26. A threaded locking ring 36 also engages the screw 26, for locking the extension tubes 30 relative to the screw 26. Where it is desired to use only the extension tube 30, a foot support 38 is used. The foot support 38 includes a threaded stub shaft 40, which engages the lower threaded plug 34.

For further extension of each leg 14, a third, extension member is provided. The third extension member comprises a threaded shaft 42. Here, the foot support 38 is dispensed with, and the threaded shaft 42 engages the lower, threaded plug 34 and can be locked by a ring 46. A second foot support 44 comprises a cylindrical foot with a threaded recess to receive the threaded shaft 42.

For the lowest height, the second and third extensions 30, 42 are not used and are stored at a convenient location. The foot supports 44 are then engaged directly with the ends of the screws 26. To increase the height of the stool 10, the extension tubes 30 are fitted, together with the foot supports 38. The extension tubes 30 can then be adjusted and then locked in position by the locking rings 36, to obtain the desired height.

To further increase the height, the extension tubes 30 are locked at their lowest position, where they just engage the ends of the screws 26. Then the threaded shafts 42 are fitted, together with the foot supports 44. The threaded shafts 42 are then similarly adjusted and locked in position by the locking rings 46 at the desired height.

By this means, it is possible to get a variation in height below the platform 12, which gives a ratio between the maximum and minimum heights of approximately 3:1. By way of example, each screw 26 can be 3 inches long and $\frac{3}{8}$ inch in diameter. The extension tubes 30 can be 3 inches in length with a $\frac{3}{4}$ inch outside diameter. The extension shafts 42 can also be 3 inches long with a $\frac{3}{8}$ inch diameter, and threaded corresponding to the threaded screws 26. The locking rings 36, 46 can be 1 inch in diameter and $\frac{1}{8}$ inch thick. The foot supports 44 can be $\frac{3}{4}$ inch in diameter and $\frac{1}{2}$ inch deep. The platform itself can be $\frac{3}{4}$ inch thick and 14 inches square. It could be formed from wood or any suitable material.

A description will now be given of the details of the actuating mechanism 18, with reference primarily to FIG. 2.

The actuating mechanism 18 includes a mounting bracket 50. The mounting bracket 50 is formed from sheet metal and has a L-shape section. The bracket 50 includes a horizontal flange 52 secured by screws to the platform 12. It also includes a vertical flange 54. The mounting bracket 50 is mounted in a slot 56 in the platform 12.

The auxiliary pedal 16 includes a connecting flange 17. This flange 17 is connected by bolts to a vertical, mounting leg 58. The mounting leg 58 is pivotally mounted near its mid point to the vertical flange 54 by a screw 60. The leg 58 is mounted on a nylon bushing around the screw 60, and delrin washers 62 are provided on either side of the leg 58 at this first pivot point.

An arm 64 is also pivotally mounted to the vertical flange 54. The arm 64 is pivotally mounted on a screw 66, corresponding to the screw 60. Again, the arm 64 is mounted on a nylon bush, and delrin washers 68 are provided on either side of the arm 64. The arm 64, like the mounting leg 58, is formed from sheet material. The arm 64 includes a rear portion 69, which is in the vertical plane. Beyond the screw 66, the arm 64 has a front portion 70 which is turned through 90°, so as to be in a horizontal plane.

A connecting link 72 is pivotally connected to the arm 64 and the vertical mounting leg 58. The connecting link 72 is pivotally connected by a screw 74 to the lower end of the mounting leg 58, and by a screw 76 to the rear end of the arm 64. Again, nylon bushings are provided around the screws 74, 76.

To the front portion 70 of the arm 64, an actuating shaft 78 is secured. The actuating shaft 78 is threaded. A nut or other internally threaded member 80 is brazed to the front portion 70, and the shaft 78 is screwed through it. A delrin lock nut 82 is provided on the upper side of the front portion 70. The shaft 78 is shown, in FIG. 2, in an inclined rest position. The shaft 78 is inclined in a forward and upward direction away from the roller 90.

The top of the actuating shaft 78 is provided with a knob 84. The lower end of the actuating shaft 78 is secured, as by riveting, to an inverted U-shape bracket 86. A shaft 88 is mounted in the bracket 86, and can be secured by "C" clips or the like. A roller 90 is mounted on the shaft 88, for free rotation.

It will thus be seen that the vertical position of the roller 90 can be adjusted by rotation of the shaft 78, the shaft 78 being rotated through an integral number of turns to maintain the roller 90 in the same orientation. The shaft 78 is locked in position by means of the lock nut 82.

A small hook 92 is secured to the vertical mounting leg 58 by a small screw, rivet or the like. A tension spring 94 engages this hook 92. A mounting location 96 for the other end of the spring 94 is provided towards the rear of the platform 12. This mounting location 96 comprises a screw 98 with a countersunk head, which is located in a corresponding bore in the platform 12. A nut 100 secures the screw 98 in position. The bottom of the screw 98 is formed with an opening 102, in which a hook at the end of the spring 94 is located. The tension spring 94 serves to urge the mounting leg 58 and auxiliary pedal 16 in a clockwise direction, to maintain the pedal 16 in the position shown in the rest position of FIG. 2.

An additional spring 104 is provided. As shown, it is located extending between the mounting location 96 and a further bracket 106 secured by screws to the under side of the platform 12. This spring 104 can be used instead of the spring 94. It provides a greater spring resistance to counterclockwise rotation of the auxiliary pedal 16 and mounting leg 58. It is intended that this spring 104 would be used, where the stool 10 would be used separately from the conventional main piano pedals 20. Thus, it would be used to enable a child to practice the pedalling action, even if this has no effect. The spring 104 would enable the feel of the auxiliary pedal 16 to be similar to that when it actually operates a main piano pedal 20.

The bracket 106 further serves as a stop for the actuating mechanism.

Figure 2:
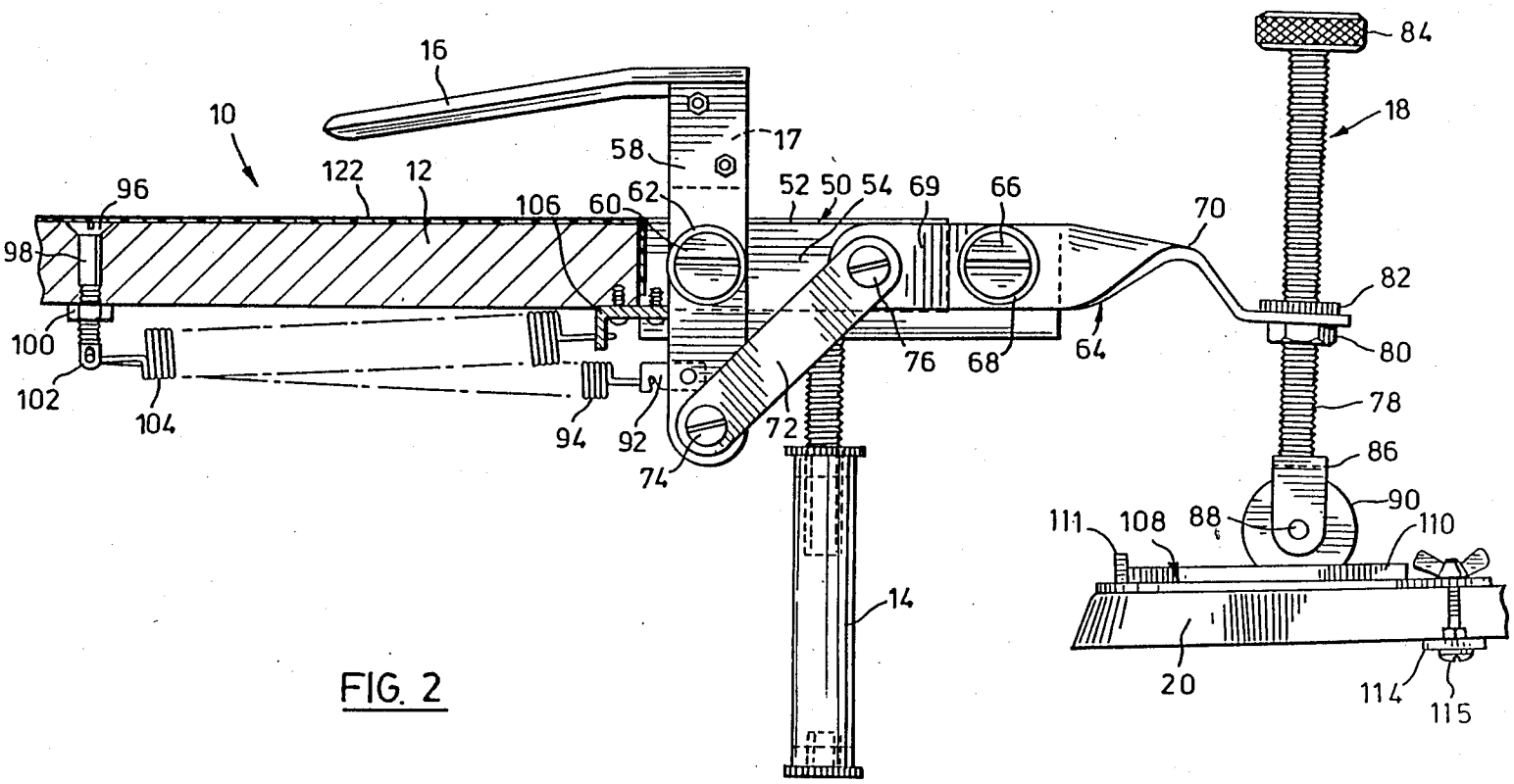
FIG. 2 shows a side view of the stool of FIG. 1.

As shown in FIG. 2, to enable the roller 90 to operate the main piano pedal 20, a roller guide 108 is provided. This guide 108 comprises a base 109, on which there are side walls 110 and an end wall 111 extending between the side walls 110. On the other side of the base 109, there are two locating ribs 112 of different length to fit a piano pedal. A clamping bracket 114 is provided. The clamping bracket 114 includes screws and wing nuts 115, for clamping it to the base 109. The side walls 110 thus define a channel for the roller 90. Consequently, the roller 90 will roll along the base 109 and depress the main piano pedal 20.

With regard to the dimensions of the actuating mechanism 18, the auxiliary pedal 16 can be approximately 3¾ inches long and 2 inches wide at its widest, and is preferably formed from brass. The rearmost part of the pedal is inclined downwards at an angle, indicated at 116 of 10°. The highest point of the auxiliary pedal 16 is 1¾ inches above the first pivot location at the screw 60. The screw 74 is 1⅛ inches below the screw 60, whilst the hook 92 is ½ inch above the screw 74. The screws 74, 76 are 2⅛ inches apart. The screw 76 is 1⅛ inches from the second pivot location at the screw 66. The first and second pivot locations at the screws 60, 66 are 2¾ inches apart.

The mounting leg 58 and the arm 64 are both ¾ of an inch wide, whilst the link 72 is ½ an inch wide.

The actuating shaft 78 is ⅜ of an inch in diameter and 5 inches long. It may be formed from brass. The knob 84 is 1 inch in diameter. The roller 90 has a rolling surface that is 1 inch wide, and 1 inch in diameter with the central portion of the roller being 1¼" in width. The roller 90 is formed from delrin.

In use, the roller guide 108 is secured to a main piano pedal 20 by the clamping bracket 114 and screws 115. The height of the stool 10 is adjusted to suit the child or person using it. Thus, as explained above, the height of the supporting legs 14 are uniformly adjusted, by the addition of the extension tubes 30 and extension shafts 42, together with the appropriate foot supports 38 or 44, as required. The stool 10 is then placed near the main, piano pedal 20 and spaced back from the piano by 3 inches. The delrin locking nut 82 is loosened, and the knob 84 rotated, to bring the roller 90 against the main piano pedal 20 near the forward end of the guide 108. The roller 90 is maintained with its axis extending transversely, as shown in the figures. Once the roller 90 has been brought to a position where it is abutting the piano pedal 20 at a location spaced slightly forward of the back of the pedal 20, then the shaft 78 is locked in position. It is locked by the locking nut 82.

The stool 10 is then ready for use. A child, or other user, would sit with his left foot resting on the platform 12, and with the heel of his right foot on the platform 12. The toe of the right foot would rest on the auxiliary pedal 16. To operate the piano pedal, the auxiliary pedal 16 is depressed downwards. This rotates the pedal 16 and the mounting leg 58 counterclockwise, against the action of the spring 94. It is to be appreciated that the spring 94 provides little tension, and most of the pedal "feel" of the auxiliary pedal 16 is the force transmitted from the main piano pedal 20. The lower end of the mounting leg 58 pushes the connecting link 72 forwards and upwards. This in turn causes the arm 64 to be rotated clockwise, by an amount that approximately corresponds to the angular rotation of the mounting leg 58.

This in turn causes the actuating shaft 78 to be displaced downwards and also rotated clockwise. As the actuating shaft 78 is displaced, the roller 90 rolls backwards along the main piano pedal 20. The roller 90 simultaneously displaces the piano pedal 20 downwards. Thus, actuation of the auxiliary pedal 16 causes the main piano pedal 20 to be operated.

When the auxiliary pedal 16 is released, the spring 94 returns it to the rest position shown. The link 72 and arm 64 are correspondingly pulled back to their rest position. The piano pedal 20 will return to its rest position, under the action of its internal mechanism.

Young children do not usually need to practice the pedalling action, but they do need a support for their feet. Thus for ages 3–5 it is usually only necessary to provide an adjustable stool. For ages 5–8, when the child uses the pedals, the auxiliary pedal is provided. Children in the age range 3–8 usually have heights in the range 37"–50". To meet their requirements, the support legs 14 are adjustable in the range 3–9 inches. For children in the age range 5–8, the auxiliary pedal needs to be provided at a height in the range 3–6 inches. The actuating shaft 78 is dimensioned to meet this requirement.

It is also to be realized that, as the auxiliary pedal 16 is depressed, the roller 90 moves horizontally rearward as well as downwards. For large heights, the horizontal movement of the roller 90 will be larger. Accordingly, it may be necessary to provide an extended roller guide 108.

Figure 4:
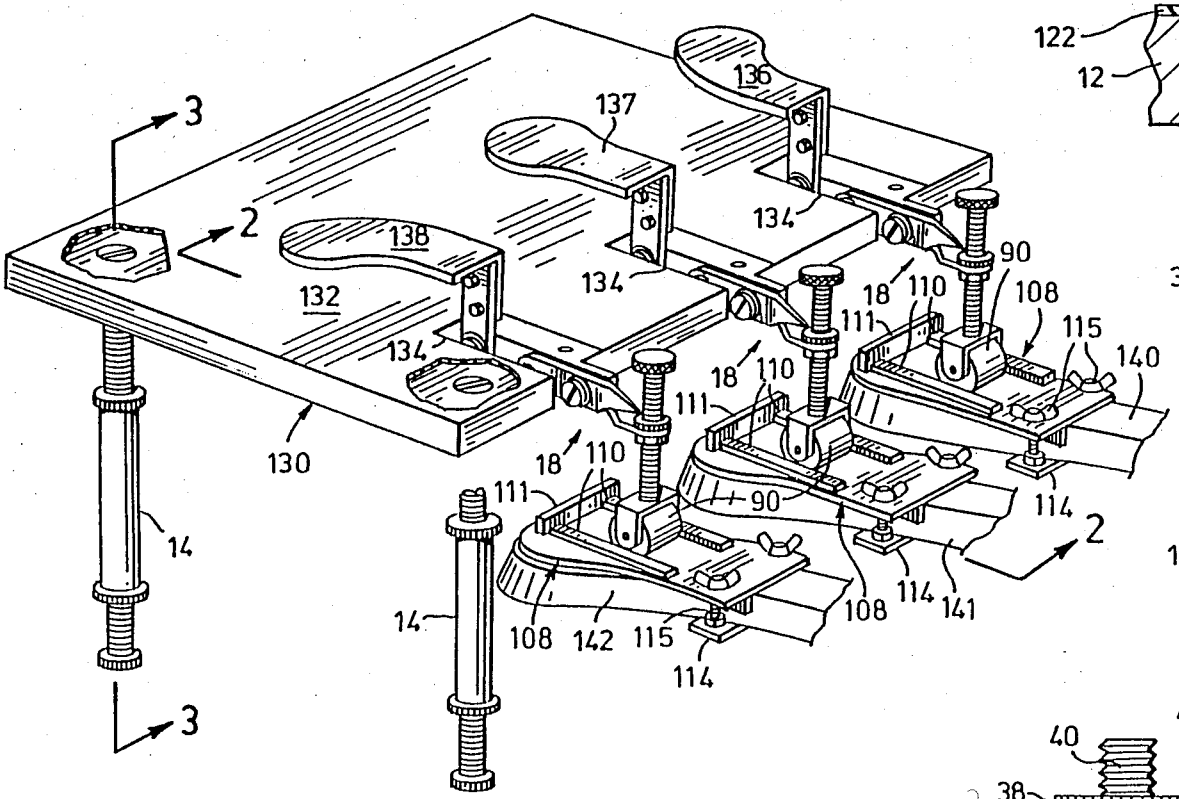
FIG. 4 shows a perspective view of a variant embodiment of the stool of the present invention.

With reference to FIG. 4, there is shown a variant embodiment of the apparatus, generally denoted by the reference 130. This second stool 130 corresponds to the first embodiment of the stool 10 in many ways. For simplicity, like parts are given the same reference numeral, and the description of them is not repeated.

This stool 130 includes a platform 132 having three slots 134. The platform 132 is provided with four supporting legs 14, as before. In each slot 134, there is provided an auxiliary pedal, with the pedals numbered 136, 137, 138. Each pedal 136, 137, 138 is connected to a respective actuating mechanism 18, which is as described above. The three pedals 136, 137, 138 are generally similar. However, the left-hand pedal 136 is turned out to the left, whilst the right-hand pedal 138 is turned out to the right.

These three pedals 136, 137, 138 are provided for operating three piano pedals 140, 141, 142 as shown. The pedals and actuating mechanisms operate as described above.

It is of course to be appreciated that the stool could be modified to include just two pedals and actuating mechanisms.

For both the embodiments, the top of the platform can be provided with a suitable, durable cover, as indicated at 122 in FIG. 1. Additionally, the rear under side of the auxiliary pedal can be provided with a resilient pad where it contacts a top of the platform.

We claim:

1. A stool, for use with a keyboard instrument including at least one main, foot pedal, the stool comprising: a platform; a first, auxiliary pedal pivotally mounted above the platform; actuating means connected to the first, auxiliary pedal and adapted to contact and actuate a main, foot pedal; a plurality of support legs extending downwardly from the support platform; and a roller and guide assembly comprising a rotatably mounted roller and a roller guide member, with one of the roller and the roller guide member being adapted for mounting on a main pedal of a keyboard instrument and the other of the roller and roller guide member being connected to the actuating means.

2. A stool as claimed in claim 1, in which the guide member is adapted for mounting to a main, foot pedal of a keyboard instrument, and includes clamping means for clamping the guide member to such a pedal.

3. A stool as claimed in claim 2, in which the roller guide member includes side walls for guiding the movement of the roller.

4. A stool as claimed in claim 3, in which the roller guide member includes a base extending between the side walls, on which base the roller travels in use.

5. A stool as claimed in claim 1, wherein each of the support legs comprises a first member secured to the platform, a second, extension member connectable to the first member and a third, extension member connectable to the second extension member.

6. A stool as claimed in claim 5, wherein the first member of each support leg comprises a threaded shaft, and the second, extension member comprises an extension tube which is internally threaded to engage the first member.

7. A stool as claimed in claim 6, wherein each supporting leg includes a first, foot support including a threaded stub shaft for engaging the respective extension tube.

8. A stool as claimed in claim 6 or 7, wherein the third, extension member comprises a threaded shaft adapted to engage the extension tube.

9. A stool as claimed in claim 6 or 7, wherein the third, extension member comprises a threaded shaft adapted to engage the extension tube, and which includes a second, foot support which includes an internally threaded bore, for engaging the threaded shaft of the first member or the threaded shaft of the third, extension member.

10. A stool as claimed in claim 1, wherein the first, auxiliary pedal is mounted for rotation relative to the platform, and the actuating means includes an arm which is rotatably mounted to the platform and is connected to the first, auxiliary pedal, so that the first, auxiliary pedal and the arm are arranged for rotational movement in opposite directions, with said other of the roller and the roller guide member being connected to the arm.

11. A stool as claimed in claim 10, wherein the first, auxiliary pedal is secured to a mounting leg, which is pivotally mounted to the platform.

12. A stool as claimed in claim 11, wherein the mounting leg and the arm are pivotally mounted to a mounting bracket secured to the platform.

13. A stool as claimed in claim 12, wherein the platform includes a slot in which the actuating means is located, and wherein the mounting bracket comprises a horizontal flange secured to the platform and a vertical flange to which the mounting leg and the arm are pivotally mounted.

14. A stool as claimed in claim 12, wherein the mounting leg and the arm are connected by a connecting link, pivotally connected to both the mounting leg and the arm.

15. A stool as claimed in claim 14, wherein the mounting leg extends generally vertically and is pivotally mounted at a first pivot location approximately at the mid point of the mounting leg, the arm extends generally horizontally and is pivotally mounted at a second pivot location with the first and second pivot locations being at the same height, and the connecting link is pivotally connected to a lower end of the mounting leg and extends upwards and forwards at an angle of 45° to the vertical to the arm with the other end of the connecting link pivotally connected to an end of the arm between the first and second pivot locations.

16. A stool as claimed in claim 12, 14 or 15, wherein the arm is formed from sheet material, and comprises a rear portion which extends in a vertical plane, and a front portion, in front of the second pivot location, which extends in a horizontal plane.

17. A stool as claimed in claim 16, wherein the actuating means includes an actuating shaft that is connected to an end of the arm remote from the mounting leg, with said other of the roller and the roller guide member connected to a lowermost end of the actuating shaft.

18. A stool as claimed in claim 17, wherein the actuating shaft is threaded, the arm includes a threaded bore engaging the threaded shaft, and a lock nut secures the actuating shaft in position.

19. A stool as claimed in claim 18, wherein the actuating shaft is inclined upwardly and forwardly from the roller guide assembly at a small angle.

20. A stool as claimed in claim 2, 10 or 15, which includes spring biasing means biasing the actuation means to a rest position.

21. A stool as claimed in claim 2, 10 or 15, which includes spring biasing means biasing the actuation means to a rest position, the spring biasing means comprising two springs which are separately attachable to the actuation means, to provide different biasing forces.

22. A stool, for use with a keyboard instrument including at least one main, foot pedal, the stool comprising: a platform; a first, auxiliary pedal pivotally mounted above the platform; actuating means connected to the first, auxiliary pedal and adapted to contact and actuate a main, foot pedal; a plurality of support legs extending downwardly from the support platform, each of which support legs comprises a first member secured to the platform, a second, extension member connectable to the first member and a third, extension member connectable to the second extension member.

* * * * *